United States Patent [19]

Niehaus et al.

[11] 4,364,319

[45] Dec. 21, 1982

[54] CONTROLLED THREAD CLAMP DEVICE FOR NEEDLE THREADS

[75] Inventors: Hermann Niehaus, Steinhagen; Günter Droste, Leopoldshöhe; Wilhelm Stapel, Bünde, all of Fed. Rep. of Germany

[73] Assignee: Dürkoppwerke GmbH, Bielefeld, Fed. Rep. of Germany

[21] Appl. No.: 27,855

[22] Filed: Apr. 6, 1979

[30] Foreign Application Priority Data

Apr. 8, 1978 [DE] Fed. Rep. of Germany ..... 2815297

[51] Int. Cl.[3] ..... D05B 29/00

[52] U.S. Cl. ..... 112/238; 112/253; 112/254

[58] Field of Search ..... 112/238, 253, 254, 293, 112/294, 295

[56] References Cited

U.S. PATENT DOCUMENTS

| | | | |
|---|---|---|---|
| 2,885,985 | 5/1959 | Kells | 112/253 |
| 2,902,960 | 9/1959 | Ketter | 112/254 X |
| 3,960,098 | 6/1976 | Papajewski et al. | 112/238 X |

FOREIGN PATENT DOCUMENTS

| | | | |
|---|---|---|---|
| 6660330 | 9/1967 | Fed. Rep. of Germany | 112/253 |

*Primary Examiner*—Ronald Feldbaum
*Attorney, Agent, or Firm*—Karl F. Ross

[57] ABSTRACT

In a double-needle lock-stitch sewing machine, an assembly for arresting threads being drawn from the needles by an uptake stroke of a thread lever, thereby ensuring predetermined lengths of thread at the needles for an ensuing stitch, comprises a spring-loaded clamp disposed between the sewing lever and the needles. The clamp is periodically actuatable via a system of levers in the sewing-machine head by a cam mounted on the sewing-machine base and cooperating with a radial lug on a shaft driving a rotary thread gripper and bobbin holder. A spring-loaded plate engaging a pair of thread-tension control disks is pivotable by the lever system to release the disks upon actuation of the clamp. The clamp is particularly useful in controlling the length of a leading thread portion prior to beginning a sewing seam.

13 Claims, 4 Drawing Figures

CONTROLLED THREAD CLAMP DEVICE FOR NEEDLE THREADS

FIELD OF THE INVENTION

The invention relates to a controlled thread clamping device for the needle threads on a sewing machine having a thread-tensioning device releasably controlled by the lower shaft.

BACKGROUND OF THE INVENTION

For the formation of unobjectionable starting stitches, it is required to clamp the needle threads or provide them of corresponding length at the beginning of sewing. When the starting thread is too long, it projects from the workpiece and can be engaged by the stitch-forming tools during the subsequent stitch-forming cycles so that an unclean seam results and a subsequent cutting of the starting thread is required. When the starting thread is too short, dropped stitches can result from the raveling of the thread. The correct starting thread length is difficult to determine especially when endless multifilament and most especially when monofilament sewing threads are used since these sewing threads have special elongation characteristics. To prevent a raveling of the needle thread with very short needle threads, controlled thread clamping devices are known which clamp the needle thread for the formation of objection-free starting stitches.

The German utility model 6 603 307 provides, for this purposes, a controlled thread-clamping device for the needle thread of a stitch group or cluster sewing machine which is brought automatically to a standstill at the end of a working cycle, whereby the fabric clamp foot is released, the thread separated and the needle bar briefly held at the upper deadpoint. With such a controlled thread clamping device, it is a disadvantage that the needle thread, although clamped, can because the clamp is arranged directly on the needle bar, only be prevented from unthreading. The length of the starting thread is here not determinable.

OBJECT OF THE INVENTION

The object of the invention is to avoid the aforedescribed disadvantages and, in addition, to provide the respective required lengths of the starting thread for the beginning of a seam.

SUMMARY OF THE INVENTION

According to the invention a thread clamp is disposed in a region between the thread lever and a needle eye and is coupled with a releasable thread-tensioning device. Thus the control means is provided as an entrainer found on the lower shaft and a release lever for the timed engagement within the working cycle of the sewing machine. Through the thread clamp, the thread section corresponding to the respective requisite length of the starting thread is clamped shortly before the reaching of upper deadpoint by the thread lever, and the thread-tension device is thereby released. Advantageously, the thread clamp comprises a thread guide plate formed with a bend, a frustocone having a frustoconical surface and a rotatable rocking lever. Advantageously this lever has a rocking arm bearing upon a release pin and a further rocking arm bearing against the frustoconical surface. Thus the thread clamp is advantageously connected to a Bowden cable which is actuated via an entrainer on a release ring. For determining the length of the starting thread, the entrainer can be brought into operative engagement with a ramp surface selectively in a timed manner within the sewing machine cycle.

SPECIFIC DESCRIPTION

Figure 1:
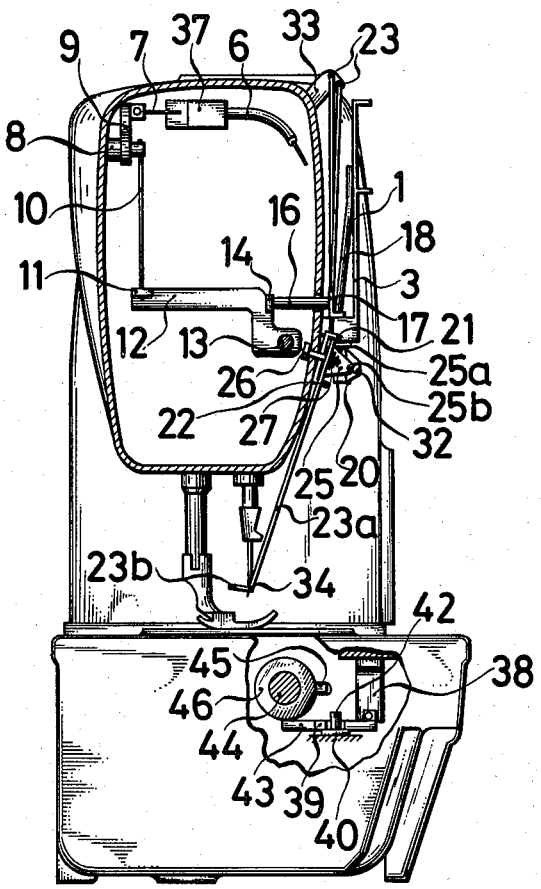
FIG. 1 a sewing machine in a partially broken-away front view illustrating a thread-clamping device according to our present invention.
Figure 2:
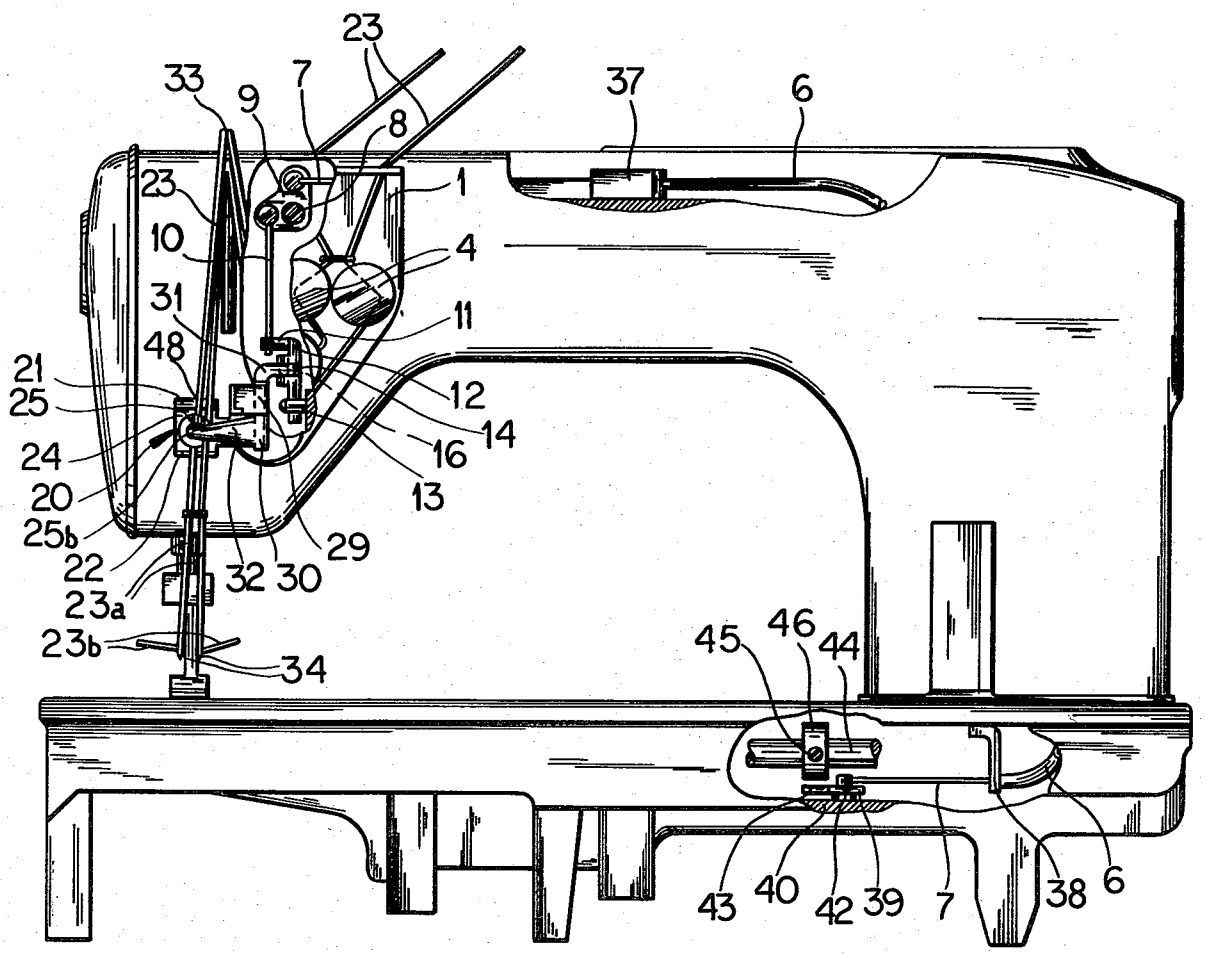
FIG. 2 the sewing machine of FIG. 1 in a partially broken-away side view.

A sewing machine of a known type shown in FIGS. 1 and 2 is provided with a releasable thread-tensioning device 1 and a controlled thread-clamping device for establishing a requisite starting thread for the beginning of a sewing seam. On a mounting plate 3 (FIG. 1) of the thread tensioning device 1, there are arranged thread tensioning discs 4 (FIG. 2) affected by compression springs (not shown). Via a Bowden wire 7 in a Bowden cable 6, a rockable lever 9 can be swung about a fixed pin 8, the lever being provided with a further Bowder wire 10 which is hung at its other end in a bend 11 of a tension-release lever 12. The tension-release lever 12 is pivotally journaled on fixed pin 13 and is provided with a further bend 14 in operative connection with a release pin 16.

Figure 3:
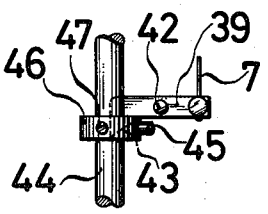
FIG. 3 a detail view of a clamping control device.

The release pin 16 bears further on a bend 17 (FIG. 1) of a release plate 18 and actuates at a predetermined time the disengagement of the thread tension device 1 with simultaneous actuation of a thread clamp 20. The thread clamp 20 is disposed in a region between a thread lever 33 and a needle eye 34 and is comprised of a thread guide plate 24 provided with bends 21 and 22 which guide a needle thread 23. A frustocone 25 is fixed to the thread guide plate 24 by a screw 26 and is provided with frustocone surfaces 25*a* and 25*b* (FIG. 2), the frustocone 25 being biased by a compression spring 27 (FIG. 1). A rocker lever 30 on a pivot 29 is provided with a pivot arm 31 (FIG. 2) resting upon the release pin 16 and a further pivot arm 32 resting against the frustocone surface 25*b*. The thread lever 33, in known manner, draws the respective required needle thread 23 from the thread supply during its upward movement. Below the thread clamp 20, a thread section 23*a* and a starting thread 23*b* are shown. The Bowden cable 6 is guided by means of a strap 37 and an angle 38 and is connected to a release lever 39. The release lever 39 is journaled via a pin 42 rotatable on the sewing machine base plate and is provided with a camming surface 43. A release ring 46 is adjustably mounted on the lower shaft 44 and is provided with an entrainer 45. The release ring 46 is adjustable by means of a setscrew 47 to establish the length of the starting thread 23*b*. To guide the needle thread 23, thread guide slits 48 are machined in the bends 21 and 22 of the thread guide plate 24. In the detail illustration of FIG. 3, the release lever 39, journaled upon the fixedly located pin 42 and which is connected to the Bowden wire 7 and has cam surface 43, is shown. By means of the setscrew 47, the release ring 46 upon the lower shaft 44 can be selectively brought into play with its entrainer 45.

Figure 4:
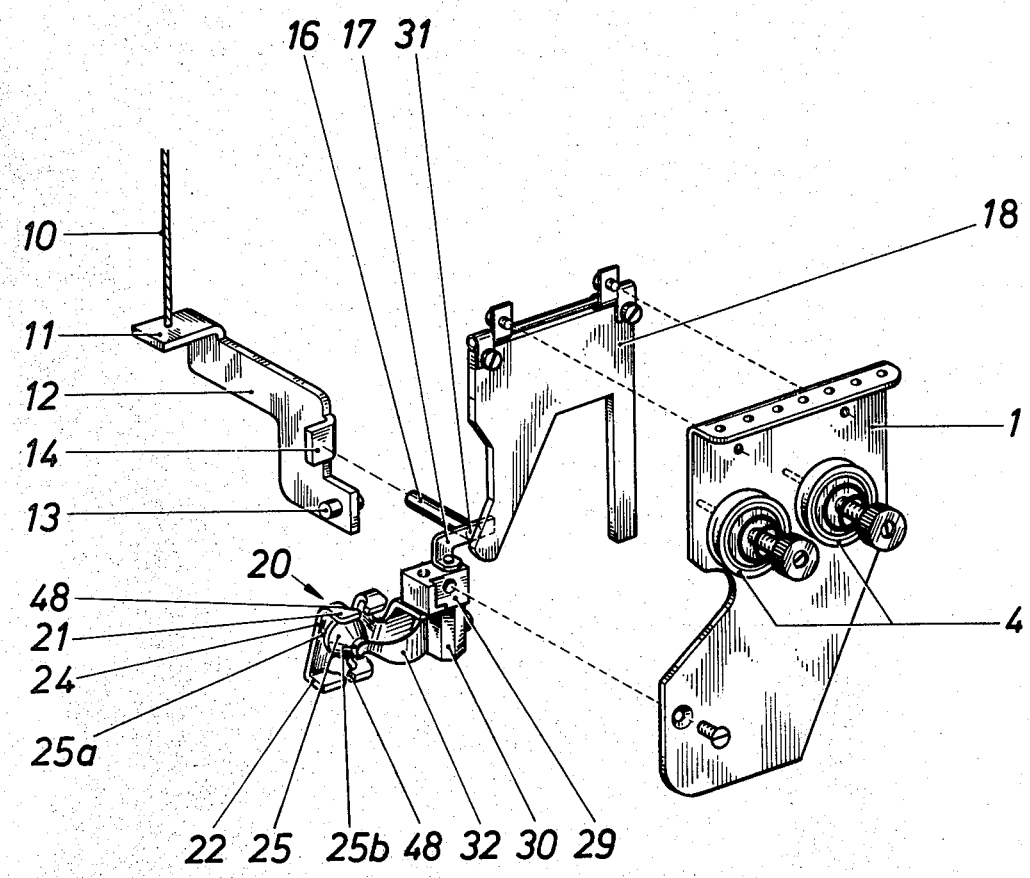
FIG. 4 is an exploded view showing the actuating system for the thread clamp and for release of the tension units in greater detail.

As can be seen from FIG. 4, the pin 16 bears on the lever arm 31 to rotate member 30 in member 29 and thereby entrain the lever 32 in an angular displacement. Member 31 can also engage that extension 17 of member 18 which articulated at its upper end at its connection to member 1 so that member 18 can bear upon tension release pins shown in broken lines in FIG. 4 and release the tensioning devices 4.

The operation of the thread-clamping device is the following.

The thread clamp 20 arranged in the region between the thread lever 33 and the needle eye 34 is actuated by the rocker lever 30 when the release pin 16 on the pivot arm 31 and the release plate 18 interact. The thread discs 4 are then lifted and the needle thread 23 freed. The frustocone 25 is pressed with its surface 25*a* against the needle thread 23 via the engagement of pivot arm 32 with the frustocone surface 25*b*. This process occurs shortly ahead of the attainment of the upper deadpoint by thread lever 33. the thread lever 33 draws the needle thread 23 back out of the needle eye 34 until the desired length of the starting thread 23*b* for the further stitch process results since, during this period, the needle thread 23 is clamped by the tension discs 4. Upon presentation of the desired length of the starting thread 23*b*, the thread tensioning device 1 with its thread tension discs 4 is released by the release pin 16 in connection with the release lever 39 and simultaneously drives the rocker lever 30 via the pivot arm 31.

Thus, when the pin 16 is displaced by member 12, it presses against arm 31 to rotate this arm and the body 30 affixed thereto in the clockwise sense (FIG. 4) and also urges the arm 31 against the extension 17 of member 18.

Member 18 is thus pressed toward the plate 1 to depress the pins of the threaded tension units 4 outwardly and relieve the pressure of the respective compression springs.

The rotation of arm 31 and body 30 in the member 29 which is connected to the plate 1 by the lower screw shown in FIG. 4, simultaneously operated lever 32 and hence the threaded clamp.

The pivot arm 32 thereby acts upon the frustocone surface 25*b* of frustocone 25, whereby the latter with its frustocone surface 25*a* against the effect of the compression spring 27 is pressed against the needle thread 23., Consequently the needle thread 23 in the thread section 23*a*, which extends from the thread clamp 20 to the needle eye 34, is held fast. the thread lever 33, which corresponding to the working cycle of the sewing machine tends to move through the upper deadpoint, can no longer draw the thread 23*a* and the required needle thread length 23 is then drawn via the disengaged thread tensioning disc 4 so that the previously determined length of the starting thread 23*b* lies at the respective needle eye for a further sewing start. The length of the starting thread 23*b* is determined by the timing of the engagement of the entrainer 45 on the cam surface 43. This timing is selected by the setting of the release ring 46 upon the lower shaft 44 corresponding to the desired length of the starting thread 23*b*.

The embodiment of the thread clamp 20 is naturally not limited to this example. It can be provided such that the engagement of the thread clamp with the needle thread can permit looping of the latter about a known bobbin housing (not shown) to thereby relieve the thread lever 33. This has a supporting effect upon the motorized drive so that the sewing machine has an improved uniform operation.

We claim:

1. In a sewing machine having a thread lever, a needle bar carrying a needle having a needle eye, and a thread-tensioning device releasably controlled by a lower shaft of the machine, a controlled thread-clamping device comprising:

a thread clamp disposed in a region between said thread lever and said needle eye, the thread clamp being coupled with said thread-tensioning device for alternating control of a needle thread passing between said lever and said eye; and control means for timed engagement of the thread clamp within a working cycle of the sewing machine to clamp a leading thread section shortly before the reaching of upper dead point by the thread lever thereby presenting a respective desired length of the starting thread, and to release the thread-tensioning device, said control means including a release ring mounted on said shaft, an entrainer cyclically displaceable by said ring, and coupling means connecting intermittently said entrainer with said clamp.

2. The machine defined in claim 1 wherein said thread clamp comprises a guide plate and a frustocone formed with frustocone surfaces and further with a rotatable pivot lever.

3. The machine defined in claim 2 wherein said pivot lever comprises a pivot arm engageable with a release pin and a further pivot arm lying against one frustocone surface of said frustocone.

4. The machine defined in claim 3 wherein said coupling means includes a Bowden cable between said entrainer and said release pin.

5. The machine defined in 4 wherein said thread clamp is arranged upon a guide plate formed with thread-guide slits.

6. The machine defined in claim 1 wherein a timed engagement of said thread clamp is provided with the needle thread during the looping around a bobbin housing.

7. The machine defined in claim 1 wherein said coupling means includes a release lever provided with a cam surface engageable by said entrainer.

8. In a sewing machine having a thread-uptake lever and a sewing needle, a sewing thread generally passing through an aperture in said lever and an eye in said needle, an assembly for providing at said needle upon the completion of each stitching cycle a pre-established length of a leading portion of said thread, said assembly comprising:

thread-tension means disposed on said machine between said lever and a thread source for generally engaging said thread to provide same with a predetermined tension;

thread-clamping means disposed on said machine between said lever and said needle for temporarily clamping said thread during at least a terminal portion of an upward stroke of said lever;

control means on said machine connected to said thread-tension and thread-clamping means for substantially simultaneously actuating said thread-tension means to release said thread and said thread-clamping means to clamp said thread at a predetermined instant during each stitching cycle, whereby a pre-established length of a leading thread portion is provided at said needle in particular prior to the beginning of sewing a seam.

9. The assembly defined in claim 8 wherein said thread-clamping gripper means includes a guide plate and a spring-loaded clamp member engageable with said plate to clamp said thread.

10. The assembly defined in claim 9 wherein said control means includes a plurality of levers engageable with said clamp member to shift same into engagement with said plate.

11. The assembly defined in claim 10 wherein said control means further includes camming means cooperating with a bobbin drive shaft to actuate via said plurality of levers said thread-tension means and said thread clamping means to respectively release and clamp said thread during said terminal portion.

12. The assembly defined in claim 11 wherein said control means further includes a Bowden cable connecting said camming means to said plurality of levers.

13. The assembly defined in claim 9, 10, 11 or 12 wherein said clamp member comprises a frustocone and said plurality of lever includes a rotatable pivot lever having a pivot arm engaging a surface of said frustocone.

* * * * *